US005839983A

United States Patent [19]

Kramer

[11] Patent Number: 5,839,983

[45] Date of Patent: Nov. 24, 1998

[54] ADJUSTABLE GRIPS FOR A BALL BAT

[76] Inventor: Robert M. T. Kramer, 1011 SW. 29th Ave., Fort Lauderdale, Fla. 33312

[21] Appl. No.: 581,455

[22] Filed: Dec. 29, 1995

Related U.S. Application Data

[63] Continuation-in-part of Ser. No. 187,308, Jan. 25, 1994, abandoned, which is a continuation-in-part of Ser. No. 89,712, Jul. 9, 1993, abandoned.

[51] Int. Cl.[6] ..... A63B 59/06

[52] U.S. Cl. ..... 473/568; 473/451

[58] Field of Search ..... 273/72 R, 72 A, 273/26 B

[56] References Cited

U.S. PATENT DOCUMENTS

| | | | |
|---|---|---|---|
| 1,573,612 | 2/1926 | Johnston | 273/81.2 |
| 2,091,458 | 8/1937 | Sleight | 273/72 R |
| 2,984,486 | 5/1961 | Jones | 473/568 |
| 3,104,876 | 9/1963 | Salsinger | 273/72 R |
| 3,410,017 | 11/1968 | Wilson | 273/81.2 |

FOREIGN PATENT DOCUMENTS

| | | | |
|---|---|---|---|
| 9232 | 4/1913 | United Kingdom | 273/81 B |

*Primary Examiner*—Mark S. Graham

*Attorney, Agent, or Firm*—Malin, Haley, DiMaggio & Crosby, PA

[57] ABSTRACT

A ball bat grip for improving the gripping action of a batter for baseball or softball, which is useful for left handed or right handed players and which allows the grip to be comfortably adjusted for alignment of the knuckles. The grip includes independent upper and lower grip portions, manually moveable, made of a vinyl, rubber, or rubber-like material for aiding in the gripping power and frictional engagement with a bat surface, whether wood or aluminum bat. The upper and lower grip portions may be installed at the factory or provided with slots for joining the segments onto an existing bat. Finger channels may be included in both the upper and lower grip portions, with the upper grip portion longer, to allow a player to choke up or move the upper hand away from the end of the bat during batting. In an alternative embodiment a single elongated grip is used that can accommodate and receive both hands of the batter. The single elongated grip includes a raised or dome segment, a second embodiment that includes a raised or dome segment with finger grooves, and a third embodiment that includes the raised or dome segment and separating wall for separating fingers.

12 Claims, 4 Drawing Sheets

ADJUSTABLE GRIPS FOR A BALL BAT

This application is a continuation-in-part of U.S. application Ser. No. 08/187,308 filed Jan. 25, 1994 abandoned, which is a continuation-in-part of application Ser. No. 08/089,712 filed Jul. 9, 1993, abandoned.

BACKGROUND OF THE INVENTION

1. Field of the Invention

This invention relates to hand grips for ball bats, and in particular, to improved hand grip, for use with a baseball bat or a softball bat, independently adjustable for each hand used for playing hardball or softball. The invention may also include an alternate embodiment, comprising a single elongated grip sized to receive both hands simultaneously to provide tactile sensations for knuckle alignment for each hand. The grip can be adjusted on the bat relative to the individual's preference.

2. Description of the Prior Art

The game of baseball at all levels is typically played with either a wooden or an aluminum bat, and is used to strike the baseball. Similarly, the game of softball also uses either a wooden or aluminum bat. Although major baseball leagues still only use wooden bats, many college leagues and little league organizations employ the aluminum bat. Heretofore, players have often worn gloves to increase their gripping power when gripping the typical part of the bat that is used when striking the ball. Often the wood or metal surface of the bat can be slippery, especially if the hands are sweaty, and players use an additional sticky substance such as pine tar in conjunction with gloves to achieve a better grip on the bat. Because of their slick metal surface, aluminum softball bats come with adhesively attached tape that provides some form of grip. One of the great drawbacks of this type of tape grip is that the tape quickly becomes worn and is then no longer suitable as a gripping surface. Using tar with batting gloves is often an unpleasant experience because of the sticky substance attaches to other parts of a player's clothing and has a very distinctive unpleasant odor.

The present invention overcomes the problems of the prior art by providing for a substantial bat grip that includes upper and lower separated segments that allows for use of both hands independently and/with either a left handed or right handed player. The grip includes finger grooves and/or longitudinal raised surface portions for proper wrist roll and for better holding power and is adjustable for knuckle alignment. Each segment includes a vinyl or rubber-like tubular member that is sized to fit snugly around the lower stock portion of the bat, regardless of whether it is wood or aluminum while permitting adjustable placement of each grip segment. Using the present invention, the batter can grip the lower portion of the bat which includes one bat grip as well as an upper portion of the bat which includes the second grip. This arrangement allows the hands and especially the knuckles to adjust to the proper position.

In an alternative embodiment of the invention, the grip may be constructed of a single elongated vinyl or rubber tubular like member that is sized to fit snugly but movably around the lower stock portion of the bat, with the grip length being sized to receive both hands simultaneously. The single elongated grip sized for both hands at the same time can include a dome or raised exterior surface segment that gives tactile information to the hands to tell where the knuckles are relative to the grip on each hand for proper knuckle alignment. The single elongated grip for both hands simultaneously may also include a plurality of finger grooves with enough grooves to accommodate both hands simultaneously on the single grip and/or a combination of the dome or raised segment and finger grooves to allow for proper knuckle alignment.

The single elongated grip for both hands simultaneously may also include an elongated longitudinal (from end to end) slot (or slit) which allows the grip body member to be resiliently spread apart to permit attachment to an existing bat and which may also include adhesive tape for wrapping all or portions of the single grip to hold the slit together flush once the grip has been positioned on the bat. The grip may also be installed at the factory and/or as an after-market product by sliding it over the end of the bat or, with a slotted embodiment, attached to an existing bat and securing with a continuous spiral of tape.

The present invention can be constructed and sized so that it is capable of being attached to an existing bat or, in the alternative, the improved grip could be installed at the factory.

SUMMARY OF THE INVENTION

A grip for use with a ball bat such as a hardball or softball bat used to play the game of baseball and softball. The grip is comprised of a first resilient body and a second body, each of the first and second tubular bodies having tubular channels disposed therethrough and sized in diameter to fit snugly but movably around the outside surface of a conventional ball bat. For example, the inside diameter of the resilient grip tubular channel could be 0.200 inches smaller than the outside diameter of the bat handle. The first body and second body all composed of a material such as vinyl or rubber that creates good frictional contact between the epidermis of a player's hands, the grip and the outer surface of the bat grip segments.

In one embodiment, the integral tubular segments are installed at the factory. Each segment can be firmly rotationally and longitudinally moved with sufficient pressure, relative to the bat so that there are upper and lower positionable hand grips which can accommodate the particular gripping style of the user. The upper body member can be longer than the lower body member in order to allow for greater latitude of movement with the user's upper hand when batting to choke up. In the alternative, the upper body member may be the same length, equal in size, to the lower body member.

The outer exterior surface profile of each of the first and second grip segments include multiple shallow channels that receive the fingers of each hand of the user to prevent slippage and allow for greater gripping power, and/or include a longitudinal raised surface that allows the fingers to be bent around to more tightly grab the grip along a raised ridge portion for aligning the knuckles. One individual channel is provided for each finger and is defined by raised ridges which makes it virtually impossible for the hands to slide longitudinally along the grip.

In an another alternate embodiment, the exterior surface of each grip segment may include a substantially semicircular portion outer exterior and a longitudinal somewhat triangular ridge portion on one side that allows the fingers to be bent to more tightly grab the hand grip along a raised ridge portion and to align the knuckles.

The first and second grip segments comprising the hand grip may be installed on the bat at the factory using a solid tubular embodiment or after the endcap is added, the solid tubular embodiment can be stretched around the endcap, attaching to the bat handle or with a slotted embodiment at a later time for attachment to an existing bat. Each hand grip segment is constructed of a uniform material such as vinyl, vinyl plastic, pvc, rubber, or any synthetic rubber-like resilient or semi-resilient material that makes a good frictional surface contact to provide surface frictional contact between the bat surface on the inside channels of the first and second grip segments when squeezed and exterior frictional surface between the epidermis of each hand and the exterior surface material of the first and second grip segments. However, each grip can be individually moved, rotated and positioned longitudinally.

In another embodiment, the grips may be made in two separate halves and joined together by fasteners or an expandable O-ring that can be stretched diametrically to allow the hand grips to be disposed over the bat end and around the bat handle and firmly held in place.

The purpose of using two, individual grip segments is to allow adjustment and positioning of each hand individually for knuckle alignment and wrist roll during the swing. A left handed or right handed hitter can use the grips. Separate rotation and longitudinal movement of the first and second grip segments relative to each other on the bat handle can be manually done. This may be required in view of each individual's grip, as compared to either right and left handed hardball players and softball players. Oftentimes, players grip up or choke up with the upper hand, which is compensated for by the extra length of the upper grip and may also be compensated by allowing different grip positions circumferentially, i.e. for knuckle alignment between the left hand and right hand when gripping the bat. Thus, each of the lower grip and the upper grip segments can be individually adjusted rotationally relative to the bat for perfect hand grip adjustment and knuckle alignment. Both upper and lower grip segments may be positioned up or down on the bat surface to allow players to grip up or choke up using both hands.

To utilize the device, the first and second grip segments may be installed at the factory directly around the bat handle. When using split grip segments, the user may install each one by placing and spreading each of the segments over the lower portion of the bat handle and firmly forcing the group segment around the bat. Using the fastener or O-ring stretchable version, separable grip components, each of the first and second gripping members would be pulled apart and slid over the end of the bat, close to its grasping end, and moved in place as desired. As discussed above, the upper grip can be 2 to 4 inches longer than the lower grip, which allows the upper gripping hand of the batter to be adjusted up or down on the top grip. Once both segments of the grip are installed and each grip portion adjusted to fit the batter's own style, the bat is ready for use and play.

Each of the grip segments is preferably made of a synthetic rubber that acts like a resilient yet somewhat hard which allows by proper sizing the inside diameter of the grip segment relative to the bat handle outside diameter for snug yet slidable and moveable positioning of each grip segment. In particular, 0.200 inch under the outside diameter of the bat for the inside diameter of each grip segment channel allows a very snug fit around the bat for each grip segment. However, there is still enough resilient give to allow each piece to be manually moved either rotated or slid longitudinally to achieve the exact positioning of each individual grip segment required. Once the grip which has a resilient consistency is squeezed by the hand then the frictional contact between the inside grip segment wall and the bat outer surface increases the coefficient of friction so that there is no possible movement of the grip relative to the bat while being squeezed firmly. When it is not squeezed firmly, each grip can be manipulated manually for movement for positioning purposes. The grip material may also be good for sweat absorption on the hands in that it is a synthetic rubber material preferably. The great advantage of positioning each individual grip segment is that the knuckles can be properly aligned and while the ball is being hit there is wrist action where the wrist roll because the knuckles are in the proper position. Preferably the grips have individual lengths that will definitely encompass the full hand left and right of the user so that it is not just a segment. With the smaller grip which is generally the lower grip there are at least four channels for fingers while with the upper grip there may be additional channels which allows the person to choke up on the bat if required.

Another advantage of using the grip is that it greatly increases a person's grip on the bat without having to use pine tar or batting gloves. A second advantage is that it can reduce stinging by absorbing some of the shock that may be obtained from hitting the ball. It could also reduce vibration and even blistering on the hands from using the bat. The device allows for a firmer grip, especially in cold weather. The primary advantage is individual adjustment and position of each hand on the bat for knuckle alignment.

In an alternative embodiment, the invention could be constructed of a single elongated grip made of vinyl or vinyl-like or rubber or rubber-like material that has some resilience while having memory that allows the user to firmly grip a bat with both hands on the grip simultaneously forming a single grip for two hands. The elongated grip shall have a dome or protruding surface segment that includes a raised straight elongated segment along one portion of the grip which allows the user to tactilely feel the circumferential surface difference to identify the location of the hands relative to the grip. The raised portion can be felt by each hand simultaneously so that the user can appreciate proper knuckle alignment. The elongated raised portion is unitarily formed with the entire grip and is comprised of the same material in a uniform manner.

The elongated single grip for both hands can also include a plurality of finger grooves, at least eight, in a side by side array along one side of the device so that the hands can have a fit on the grip with the fingers being properly aligned around the outside circumference portion of the grip. The fingers will rest in grooves that are sized to receive fingers of the user. The single elongated hand grip for two hands has simultaneously the raised extended portion that is elongated from one end to the other along with finger grooves as described herein.

The elongated grip for use with two hands as a single member will also include in one embodiment a slit along the side opposite the raised segment which will allow the grip to be attached to an existing bat along with an adhesive tape to wrap around portions of the grip. The tape could be resilient vinyl with adhesive on one side.

For the molded singular integral embodiment, the elongated grip could be placed on the bat at the factory.

To operate the invention using the single elongated grip once the grip has been installed on a bat, the user can feel the raised segment and rotate the entire grip relative to the bat so that the batter can locate the desired spot when the bat is being held. The user can also feel through the raised segment the relative location of each hand simultaneously with the single grip and adjust the hand relative to the knuckles with proper knuckle alignment.

It is therefore a principal object of this invention to provide an improved baseball or softball bat grip.

It is yet another object of this invention to provide a firm grip for use with a ball bat that allows for individual adjustment longitudinally and circumferentially between each of the hands of the user and provide proper knuckle alignment.

And yet still another object of this invention is to provide for an improved hand grip for a bat that can reduce vibration, stinging, or blistering of the hands while improving the grip on the bat.

But yet still another object of the invention is to provide a hand grip that can be installed on existing bats or permanently installed at the factory when the bat is manufactured.

In accordance with these and other objects which will be apparent hereinafter, the instant invention will now become described with particular reference to the accompanying drawings.

DESCRIPTION OF THE PREFERRED EMBODIMENTS

Figure 1:
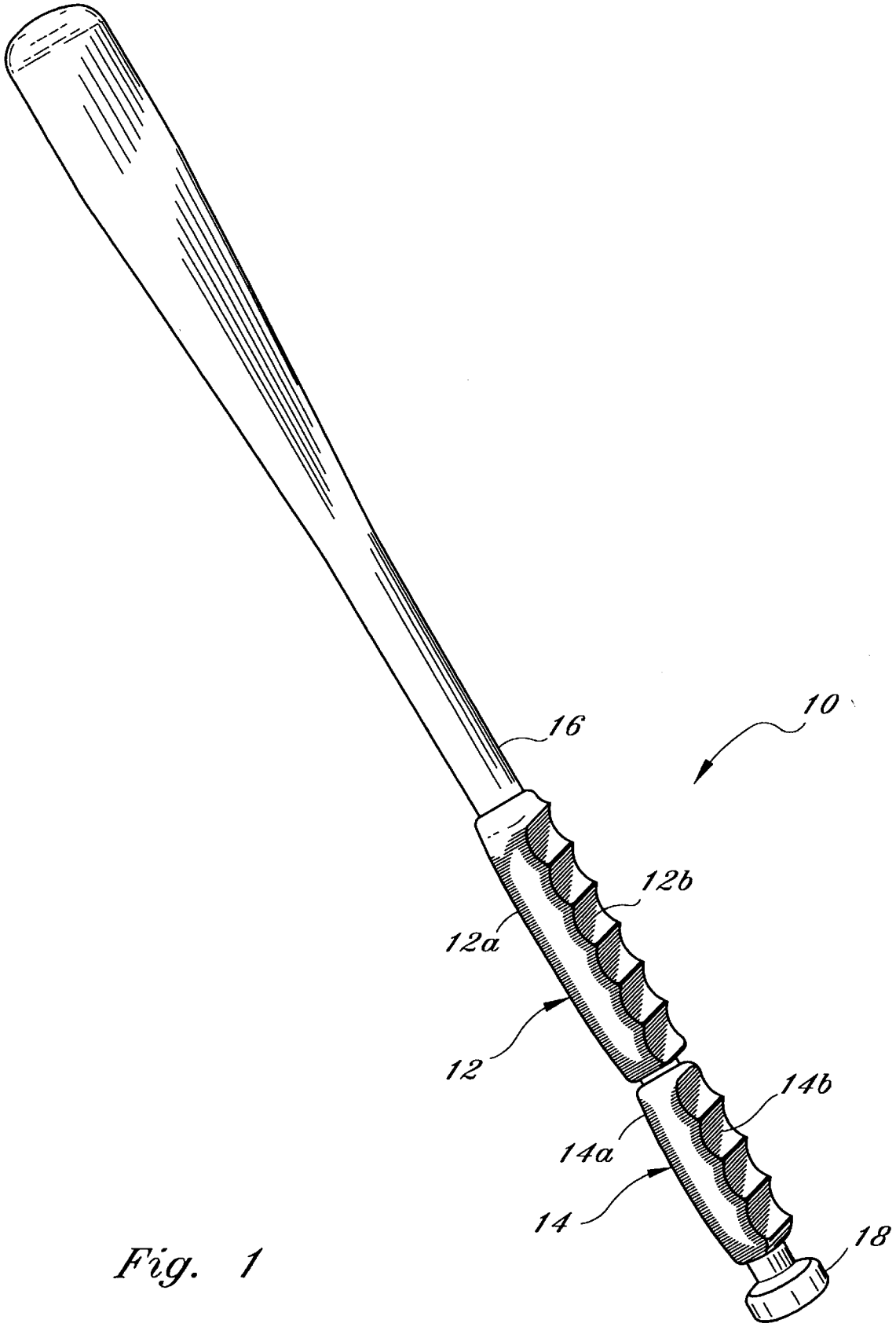
FIG. 1 shows a side elevational view of the present invention installed on a baseball bat.

Referring now to the drawings, and in particular FIG. 1, the present invention is shown generally at 10, comprised of a top grip 12 and a bottom hand grip 14 snugly attached around the lower portion of a baseball bat 16. The bat itself may be made of wood or aluminum and be used for baseball or softball. The end of the bat includes an enlarged flange portion 18 which is conventional.

The upper grip 12 is comprised of a tubular body member 12*a* and in the embodiment shown in FIG. 1, a plurality of individual finger receiving channels 12*b*, which generally are sized slightly larger than the lower portion of the human finger. The lower grip 14 includes a tubular grip body 14*a* and a plurality of individual finger receiving channels 14*b*.

The upper grip 12 and the lower grip 14 are made of a material that is suitable for providing a frictional surface between the bat 16, the inside passage of tubular member 12*a* and the inside passage of tubular member 14*a*. Typical materials could be vinyl, rubber, or any rubber-like material that is somewhat resilient, yet suitable for providing a firm grip with each hand. There is sufficient resilience in the upper grip 12 and the lower grip 14 with respect to the diameter of bat 16 so that the upper and lower grips can be twisted relative to each other and moved higher or lower on the bat handle for proper positioning, depending on the particular desires of the hitter. It can also be twisted and adjusted to accommodate both left handed and right handed hitters. The upper grip may be longer than the lower grip 14 by 2 to 4 inches to allow for additional distance and choking up on the bat by the top gripping hand, if required. FIG. 1 illustrates the grips as provided in the operable position for batting with the upper grip greater in length than the lower grip. In an alternative embodiment (not shown), the upper and lower grips may be equal in size. The thickness of each of the upper grip 12 and the lower grip 14 can be on the order of ⅛ inch or other suitable thickness to provide enough rigidity for grasping firmly without tearing or ripping apart the grip, while at the same time without making it so large in diameter that it is impractical for comfortable grasping of the bat.

Figure 2A:
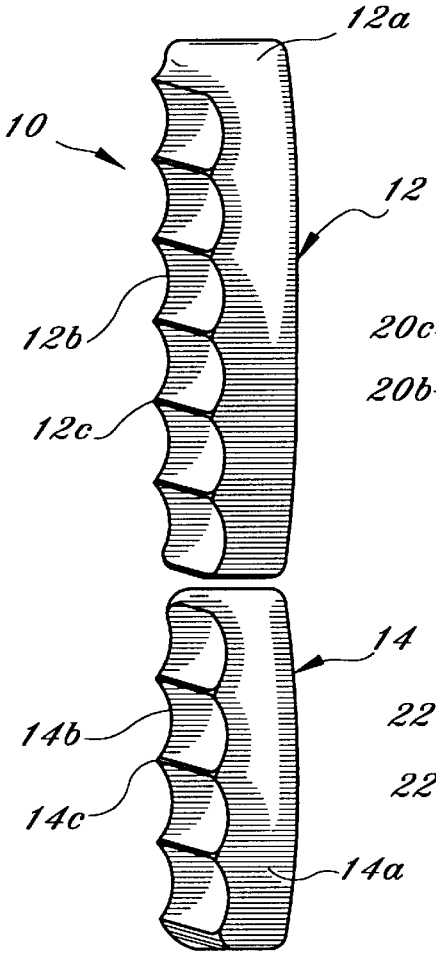
FIG. 2A shows the side elevational view shown in FIG. 1 without the baseball bat.
Figure 2B:
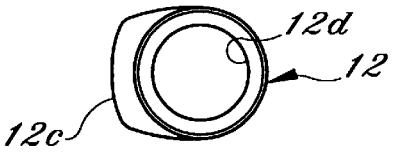
FIG. 2B shows a top plan view of the embodiment shown in FIG. 2A.

The embodiment shown in FIGS. 2A and 2B may be molded onto a bat at the factory, and are made of a unitary fashion that includes a cylindrical internal passage 12*d* that is sized in diameter to fit snugly around the lower portion of a baseball bat. As shown in FIG. 2B, the raised peripheral portions that separate the finger channels 12*b* include raised areas 12*c* which are flange-like that protrude outward, providing for raised separation points between the finger channels 12*b*.

Figure 3A:
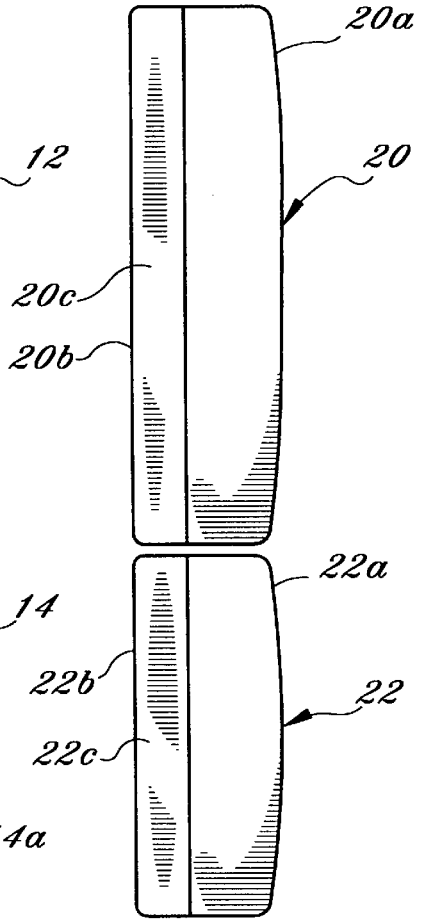
FIG. 3A shows a side elevational view of an alternate embodiment of the invention.
Figure 3B:
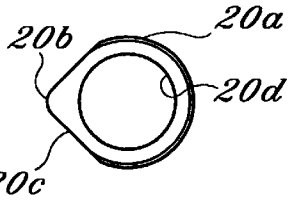
FIG. 3B shows a top plan view of the alternate embodiment shown in FIG. 3A.

FIGS. 3A and 3B show an alternative configuration of the outer surface of the grip, which may involve a substantially circular portion which is over half of the circumferential distance around the outside surface of upper grip 20 and lower grip 22 with a triangular shaped portion, having walls 20*c* and apex 20*b*, formed on the opposite side from the circular portion. This configuration also can be firmly gripped and is used to give additional tight finger grip control on the device. The inside channel of the upper grip 20 and the lower grip 22 is shown in FIG. 3B as a cylindrical channel 20*d*, which again has a diameter so that a bat 16 will snugly fit within passage 20*d*, preventing basic rotation of the grip. The passage 20*d* is the same in both the lower grip 22 as it is shown for upper grip 20. Note the circular portion, which is approximately 60% of the circumference as shown in FIG. 3B.

Figure 4A:
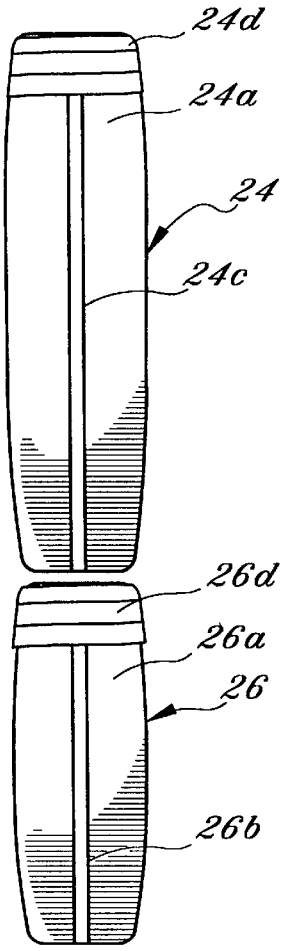
FIG. 4A shows a back elevational view of yet another alternate embodiment of the invention.
Figure 4B:
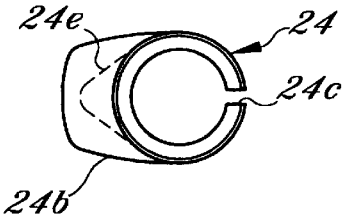
FIG. 4B shows a top plan view of the alternate embodiment shown in FIG. 4A, element 24.

Referring now to FIG. 4A an embodiment is shown that can be affixed to a bat at any time and thus can be used for any existing bat. A pair of separate grip segments 24 and 26 are shown. Each is tubular as are the other grips shown in FIGS. 2A and 3A and may include either the finger channels such as 12*b* in FIG. 2A or the triangular ridge shown as 20*b* in FIG. 3B on the front side of the grip segment. On the back side of the grip is a narrow slot 24*c* and 26*b* which allows the grip segment to be spread apart and placed around the bat handle. Tape 24*d* and 26*d* is then wrapped around the grip to firmly hold it snugly against the bat. However, there is still enough resilient give to allow each segment to be manually rotated or longitudinally slid to achieve the exact positioning of each individual grip segment required. The tape 24*d* is athletic which may be of a cloth consistency with an adhesive on one side and 26*d* is shown only partially wrapped around each segment 24 and 26 but in actual operation the tape would cover each of the entire grip segments. FIG. 4B shows a top view where it has a finger channel 24*b* or a triangular ridge 24*e* shown dotted for gripping purposes as described in the other embodiments. Note in the back side is a slot 24*c* that runs the length of the upper grip and correspondingly 26*b* slot in element 26 runs the length. This allows for an after-market product that can be added to any existing bat and does not have to be placed on the bat at the factory. The tap aids in making the unit act as a whole.

Figure 5A:
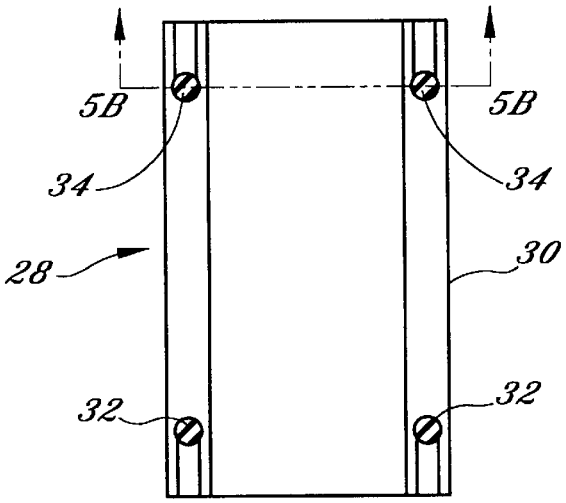
FIG. 5A shows a front elevational view, partially in cross section, of one-half of an upper or lower grip in accordance with the present invention.
Figure 5B:
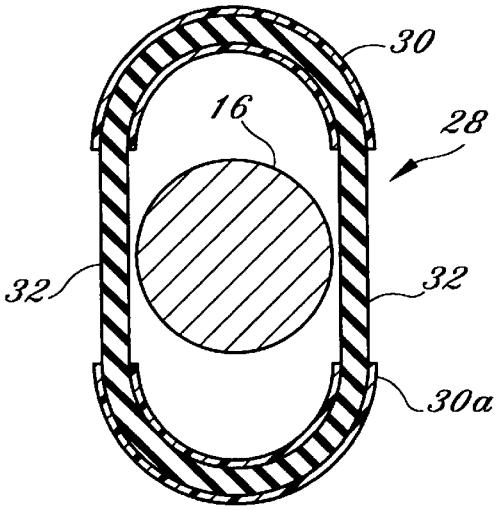
FIG. 5B shows a top plan view in cross section of the embodiment shown in FIG. 5A.

FIG. 5A and FIG. 5B show yet an alternate construction in which two halves of each grip, both the upper and the lower, are employed in order to allow the device to be fitted over an existing bat. This embodiment depicts a grip which has not previously been molded at the factory onto the bat handle. FIG. 5A illustrates one-half of either the upper or lower grip 30 that includes O-rings 32 and 34, which allow engagement with the opposing half 30*a* of the grip, both of which are joined by O-rings 32 as shown in FIG. 5B. The configuration in FIG. 5B is shown stretched and exaggerated to indicate that it fits over the existing bat 16. The O-rings are substantially circular and would require sufficient tension so that the half segments of each of the grip 30 and 30*a* would in fact fit snugly together in rigid attachment in almost a circular configuration. Each segment is also held in place by the stretchable O-rings 32 and 34 around the lower portion of the bat handle. The inside diameter of the grip member halves 30 and 30*a* are such to fit snugly around the exterior circumference of bat 16. Once the O-rings have been stretched and the separate halves of the upper and lower grips are placed over the bat in position, and the device is ready for use.

Figure 6A:
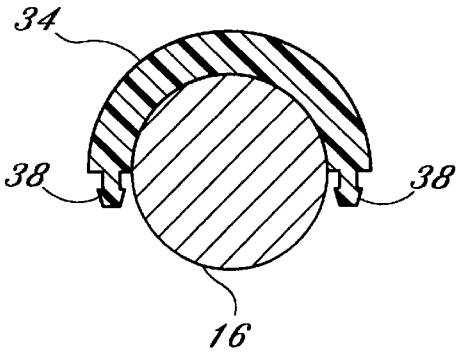
FIG. 6A shows a top plan view of half of one grip portion in cross section used with a baseball bat.
Figure 6B:
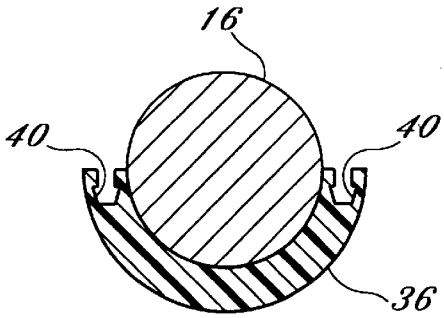
FIG. 6B shows a top plan view of the opposite grip segment in cross section, used with a baseball bat that fits together with the segment shown in FIG. 6A to form either the upper or lower grip of the invention.
Figure 6C:
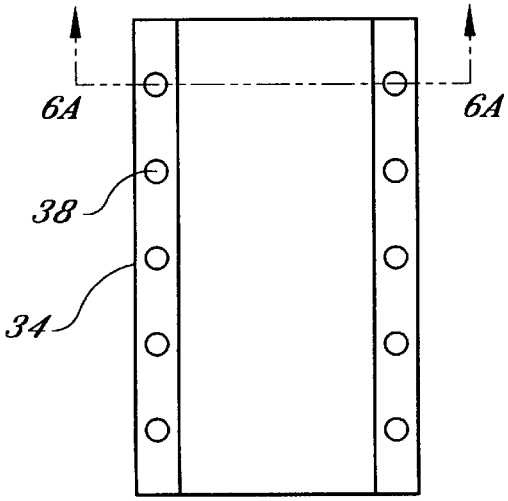
FIG. 6C shows a side elevational view of the embodiment shown in FIG. 6A.
Figure 6D:
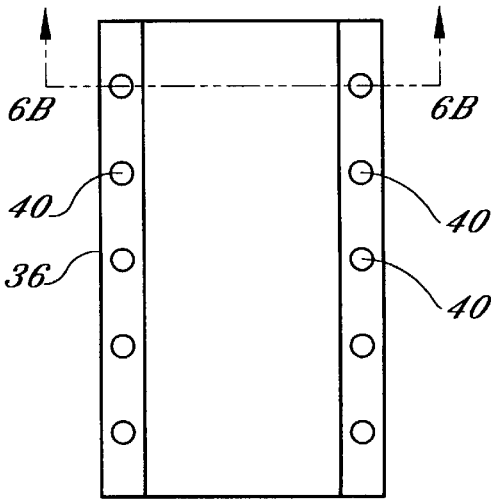
FIG. 6D shows a side elevational view of the embodiment shown in FIG. 6B.

FIGS. 6A and 6B show yet another embodiment of the invention in which each half of each of the top and bottom grips include male and female fasteners so that they can be snapped together to form the upper grip and the lower grip around an existing bat so that it is not necessary that it be installed or molded at the factory. The final plastic or rubber material may be the same as discussed above. Basically, looking at FIG. 6A, half of either the lower or upper grip is shown with a semicircular portion of grip segment 34 that includes male fasteners 38 disposed and spaced along the body members longitudinally on each side. In FIG. 6B, female apertures 40 are shown which include flange portions that engage the male fasteners 38 so that once grip segment 36 is snapped together with grip segment 34, through the use of the fasteners, the grip is essentially permanently installed on the bat. The inside diameter of each segment 34 and 36 is sized so that when engaged or snapped together, the lower and the upper portions of each grip fit snugly around the circumference of bat 16. Again, this embodiment allows for the use of the invention with bats already in existence and does not require manufacture at the factory.

Once the upper grip and the lower grip have been installed on the bat, then each of the grips may be independently twisted or moved up or down the bat handle when it is time to bat or to adjust to the individual gripping preferences of each of the users. The instant invention can accommodate both left handed or right handed users, as well as those who wish to choke up or grasp the bat down low. By using independent upper and lower grip sections, one for the left hand and one for the right hand, a completely adjustable, comfortable grip can be achieved for each player individually for each hand. Because of the snug fit and the nature of the material, the grip can be grasped firmly by the user and be used successfully for hitting the ball.

Figure 7A:
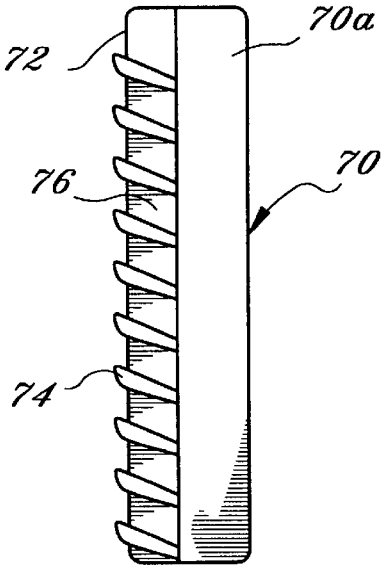
FIG. 7A shows a side elevational view of the single elongated grip sized for two hands simultaneously that includes a raised or dome segment and finger walls simultaneously.
Figure 7B:
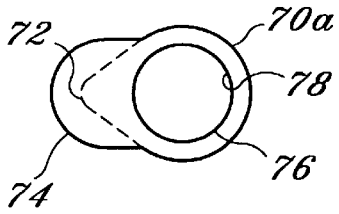
FIG. 7B is a top view of the embodiment shown in FIG. 7A.
Figure 8B:
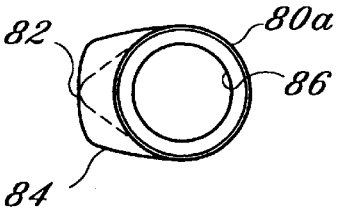
FIG. 8B is a top plan view thereof of the embodiment shown in FIG. 8A.
Figure 9B:
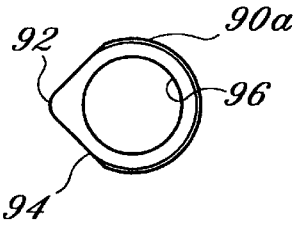
FIG. 9B shows a top elevational view of the embodiment shown in FIG. 9A.
Figure 7C:
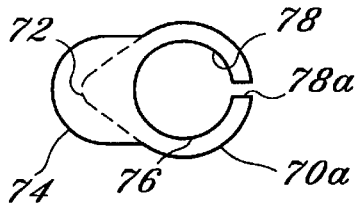
FIG. 7C is a top view of the embodiment shown in FIG. 7A, which also includes an elongated slot, which allows the grip to be installed on a ball bat, after-market.

Referring now to FIGS. 7A and 7B, an alternate embodiment of the invention is shown which is a single hand grip elongated sufficiently in length to receive and accommodate both hands of the user on a ball bat at the same time. The embodiment shown in FIGS. 7A and 7B is comprised of a unitary singular vinyl or rubber or rubber-like tube 70*a* which is to be mounted on a ball bat at the factory and is unitarily formed to include a raised segment 72 relative to the circumferential exterior surface that traverses the entire length of the grip from end to end. The inside diameter of the tube 70*a* as shown in FIG. 7B is a cylindrical wall 78. The outside surface 70*a* is contiguous with the raised segment 72 which is a raised straight line ridge from one end of the grip to the other. The grip 70 shown in FIG. 7A includes extended thin walls 74 that are spaced apart positioned circumferentially in the same exterior surface area as the raised segment 72 to provide for finger spacing. The extended walls 74 are thin, resilient walls that allow the fingers to be separated along the length of the grip 70 for both hands at the same time. Because of the raised segment 72, the tactile feeling on the user's hands will indicate where the knuckle positions are for establishing relative hand position for each hand on the grip. The inside diameter formed by the inside cylindrical wall 78 of the grip 70 is sized smaller than the bat exterior diameter as described herein for the other grips. There is enough resilience in the grip 70 so that the grip can be rotated manually relative to the bat outside surface to achieve the desired location by the user. The embodiment shown in FIG. 7C includes a slit 78*a* in the cylindrical wall 78 opposite the raised segment 72 which allows the grip 70 to be expanded while it is placed around a bat (after-market) so that it does not have to be installed at the factory. The slit 78*a* is small, such that both sides of the slit 78*a* would touch each other when in place. Pieces of vinyl having one adhesive side to affix to the grip tape may be utilized with the grip to affix the tape as shown and described above.

Figure 8A:
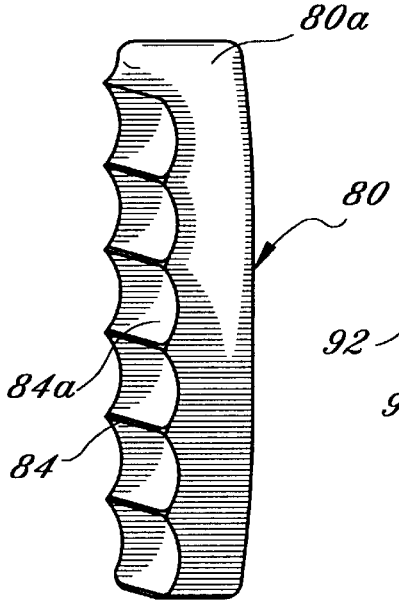
FIG. 8A shows a side elevational view of the single unitary elongated hand grip for two hands simultaneously showing finger grooves and a raised segment.
Figure 8C:
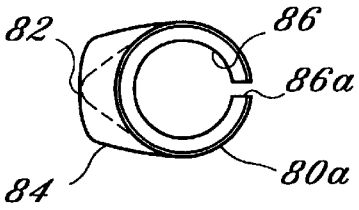
FIG. 8C is a top plan view of the embodiment shown in FIG. 8A, which includes an elongated slot to allow the grip to be installed on a ball bat, after-market.

FIG. 8A shows yet another embodiment of the invention with a single unitary grip 80 sufficiently long to accommodate both hands at the same time. This grip includes tube 80*a* having a plurality of finger grooves 84 disposed along the entire length of the grip and a central raised segment 82 that is a ridge that runs the full length of the grip 80 and protrudes within each finger groove 84. The finger grooves 84 must allow for a finger alignment of each finger of each hand with both hands on the grip while the raised segment 82 gives tactile feeling of the hands as to knuckle alignment. Each finger groove 84 includes a raised segment 82. Location 82*a* signifies one end of the finger grooves 84 and the beginning of the outside cylindrical surface of the tube 80*a*. The embodiment in FIG. 8C includes a slit 86*a* the entire length of the grip to allow the grip to be attached to an existing bat after-market as discussed herein above. The inside cylindrical wall 86 has a diameter smaller than the bat exterior diameter for a snug fit.

Figure 9A:
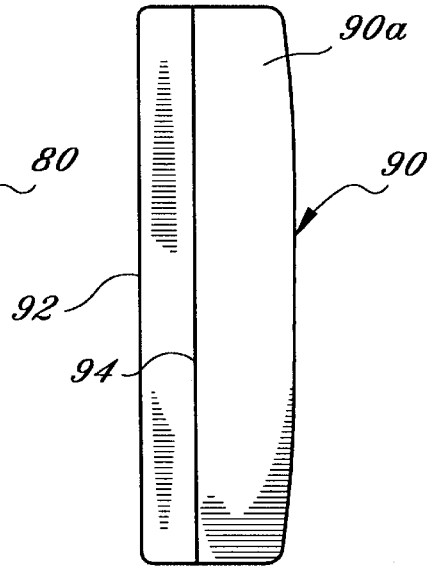
FIG. 9A shows a side elevational view of the single unitary elongated hand grip for two hands simultaneously that shows the raised segment of the grip.
Figure 9C:
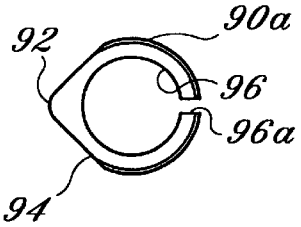
FIG. 9C shows a top elevational view of the embodiment shown in FIG. 9A with the addition of an elongated slot which allows the grip to be installed on a ball bat, after-market.

Yet another embodiment is shown in FIG. 9A that is a single hand grip to accommodate two hands at the same time that includes a single raised segment 92 relative to the exterior circumferential surface that is a ridge that extends the entire length of the grip. The inside cylindrical channel 96 is sized in diameter to snugly fit on a bat and is smaller than the diameter of the bat. The embodiment shown in FIG. 9C includes a narrow slit 96*a* along the backside of the grip which allows the grip to be attached to an existing bat (after-market).

All of the embodiments shown in FIGS. 7A, 8A and 9A can be made of the same materials as described above and include the same resiliency and memory for firmly gripping the device while at the same time allowing all of them to be moved around the bat to find the desired location by the user.

When using the single integral grip for both hands simultaneously, the material of the grip is sufficiently resilient or twistable so that the body member can be adjusted manually by twisting top and bottom hands relative to each other and relative to the baseball bat for a comfortable adjustment as a preference to the user. Thus, the elongated, raised segment used for tactilely sensing the position of the hands would not necessarily be in a direct, straight line from end to end once the grip was adjusted by twisting to the preferential locations by the user.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An adjustable grip having two independently adjustable members, one for each hand of a batter, for a ball bat for the alignment of the knuckles of each hand of the batter, for proper wrist roll and for increasing the gripping power of the batter and for reducing vibration, sting, and blistering on the hands of the batter, comprising:

a first resilient body member sized in length approximately at least a hand width for being grasped by one hand of said batter, said first body member having an inside cylindrical passage sized in diameter such that said first body member fits movably snug around an exterior surface of a lower hand-held portion of a ball bat, said first body member being essentially immovable when manually squeezed and having an exterior portion sized to fit the grip of a hand when batting, said first body member having an integrally formed frictional surface disposed on the exterior portion for increasing gripping power between the hand and the first body member exterior portion, said first body member having a continuous longitudinal raised straight surface portion for knuckle alignment integrally formed as part of said exterior surface of said first body member, said longitudinal raised surface portion extending between a first end and a second end of said first body member, said longitudinal raised portion engageable by all four fingers of one hand when said first body member is grasped by one hand; and a second resilient body member sized approximately in length at least a hand width for being grasped with the other hand of the batter, said second body member including a cylindrical channel longitudinally disposed therethrough, the diameter of said second body member channel being sized such that said second body member fits movably snug around the exterior surface of the lower hand-held portion of a ball bat, said second body member being essentially immovable when manually squeezed and including an exterior portion having an integrally formed frictional surface disposed on the exterior portion to insure frictional contact between the hand and the exterior surface of said second body member, said second body member having a longitudinal raised straight surface portion for knuckle alignment integrally formed as a portion of an exterior surface of said second body member, said second body member longitudinal raised surface portion extending between a first end and a second end of said second body member, said second body member longitudinal raised portion engageable by all four fingers of the hand when said second body member is grasped by the hand, whereby the first body member and the second body member are movable independently of each other upon said ball bat for adjusting the grip to the batter for each hand, independent of the other hand.

2. A ball bat grip as in claim 1, wherein said first body member exterior surface circumference and said second body member exterior surface circumference include a plurality of finger receiving channels disposed about one portion.

3. A ball bat grip as in claim 1, wherein said first body member includes first and second segments that can be separated and means for connecting said first segment to said second segment for fitting it and engaging it around said ball bat handle.

4. A ball bat grip as in claim 3, wherein said means for fastening said first segment of said first body member to said second segment includes male and female fasteners connected to said first and second segments.

5. A ball bat grip as in claim 3, wherein said means for fastening said first segment to said second segment includes a stretchable O-ring joining said first and second segments together.

6. A ball bat grip as in claim 3, including:

tape means wrapped around the exterior of said first and second segments.

7. An adjustable grip for a ball bat as in claim 1 wherein said first resilient body member exterior portion and said second resilient body member exterior portion include a plurality of finger separating barriers spaced apart sufficiently to allow individual fingers to be received between adjacent finger separating walls.

8. An adjustable grip for a ball bat for increasing the gripping power of a user and for alignment of the knuckles for proper wrist roll, reducing vibration, sting, and blistering on a user's hand, comprising:

a first resilient body member sized in length for being grasped by one hand, said first body member having a tubular channel longitudinally disposed therethrough, said channel being sized in diameter such that said first body member fits movably snug around a handle of a ball bat, said first body member being immovable around the handle when squeezed, said first body member having a longitudinal raised surface portion for knuckle alignment disposed on an outer surface of said first body member, said longitudinal raised surface portion extending between a first end and a second end of said first body member, said longitudinal raised portion engaging all four fingers of the one hand when said first body member is grasped by the one hand; and a second resilient body member sized in length for being grasped by the other hand of a user, said second body member having a tubular channel longitudinally disposed therethrough, said second body member channel being sized in diameter such that said second body member fits movably snug around the handle of the ball bat, said second body member being immovable around the handle when squeezed, said second body member having a longitudinal raised surface portion for knuckle alignment disposed on an outer surface of said second body member, said longitudinal raised surface portion extending between a first end and a second end of said second body member, said longitudinal raised portion engaging all four fingers of the other hand when said second body member is grasped by the other hand;

whereby said first body member and said body member are movable independently of each other when disposed upon a ball bat for adjusting the grip to the individual user.

9. A ball bat grip as recited in claim 8, further comprising said first body member having a longitudinal split to provide ends in a longitudinal direction, said longitudinal split for spreading said first body member apart and placing said first body member around the handle;

said second body member having a longitudinal split to provide ends in a longitudinal direction, said second body member longitudinal split for spreading said second body member apart and placing said second body member around the handle.

10. A ball bat grip as recited in claim 9, further comprising tape means wrapped around an exterior surface of said first and second body members for holding said first and second body members against the bat handle.

11. An adjustable grip for a ball bat as in claim 8, wherein said first resilient body member exterior surface and said second resilient body member exterior surface include a plurality of finger receiving channels disposed about one portion.

12. An adjustable grip for a ball bat as in claim 8, wherein said first resilient body member exterior surface and said second resilient body member exterior surface include a plurality of finger separating barriers spaced apart sufficiently to allow individual fingers to be received between adjacent finger separating walls.

* * * * *